US010010116B2

(12) United States Patent
Goodman

(10) Patent No.: US 10,010,116 B2
(45) Date of Patent: Jul. 3, 2018

(54) DRESS SHIRT FOR USE WITH DECORATIVE FASTENING DEVICES

(71) Applicant: Cedric Goodman, Newnan, GA (US)

(72) Inventor: Cedric Goodman, Newnan, GA (US)

(*) Notice: Subject to any disclaimer, the term of this patent is extended or adjusted under 35 U.S.C. 154(b) by 76 days.

(21) Appl. No.: 15/076,790

(22) Filed: Mar. 22, 2016

(65) Prior Publication Data

US 2017/0215486 A1 Aug. 3, 2017

(51) Int. Cl.

| | |
|---|---|
| ***A41D 3/08*** | (2006.01) |
| ***A41B 3/02*** | (2006.01) |
| *A44B 3/04* | (2006.01) |

(52) U.S. Cl.

CPC . *A41B 3/02* (2013.01); *A44B 3/04* (2013.01)

(58) Field of Classification Search

CPC .... A41B 1/12; A41B 3/04; A41B 3/06; A41B 3/08; A41B 3/10; A41B 3/14; A41B 3/00; A41B 3/005; A41B 3/16; A44B 6/00; A41F 1/02

USPC ..... 2/84, 132

See application file for complete search history.

(56) References Cited

U.S. PATENT DOCUMENTS

| | | | | |
|---|---|---|---|---|
| 148,178 | A | 3/1874 | Chase | |
| 1,333,398 | A * | 3/1920 | Elizondo | A41B 3/12 2/137 |
| 1,377,499 | A * | 5/1921 | Mullaly | A41B 3/12 2/137 |
| 1,566,932 | A | 3/1924 | Tingle | |
| 2,162,536 | A | 6/1939 | O'Mealia | |
| 2,708,272 | A | 5/1955 | Tenisons | |
| 3,168,747 | A * | 2/1965 | Rothman | A41B 1/10 2/128 |
| 3,634,911 | A | 1/1972 | Mobell | |
| 3,832,736 | A | 9/1974 | Schuchman | |
| 5,761,744 | A | 6/1998 | Horvat | |
| 8,863,315 | B1 | 10/2014 | Sanders | |
| 9,009,866 | B2 | 4/2015 | Blakely | |
| 9,155,367 | B2 | 10/2015 | Fathollahi et al. | |
| 2012/0266364 | A1 | 10/2012 | Dyon | |
| 2013/0232730 | A1* | 9/2013 | Kelly | A44B 6/00 24/66.5 |

FOREIGN PATENT DOCUMENTS

| | | |
|---|---|---|
| GB | 2331 | 3/1901 |
| GB | 20585 | 8/1912 |

* cited by examiner

*Primary Examiner* — Timothy K Trieu

(74) *Attorney, Agent, or Firm* — Moore, Ingram, Johnson & Steele

(57) ABSTRACT

The present invention relates to a dress shirt adapted with buttonholes and brackets for use with decorative fasteners, such as cufflinks, to keep the collar in place.

4 Claims, 3 Drawing Sheets

DRESS SHIRT FOR USE WITH DECORATIVE FASTENING DEVICES

CROSS-REFERENCE TO RELATED APPLICATION

The present application is a Continuation-in-Part application claiming benefit of U.S. application Ser. No. 15/013,067 filed Feb. 2, 2016, which claims benefit of U.S. Provisional Application 62/191,753 filed Jul. 13, 2015. The subject matter of that application is hereby incorporated by reference in its entirety.

FIELD OF THE INVENTION

The present invention relates to a dress shirt with a collar that allows for use of decorative fasteners or cuff-links for use to keep the collar in place.

BACKGROUND OF THE INVENTION

Collared dress shirts have been a wardrobe staple for decades but with wear the ends of the collars often roll up or under or turn unevenly. Men's dress shirts often come with a small button that attaches through a buttonhole on the corner of the collar to hold the collar down. However, these buttons are often lost quickly, are not interchangeable and often do not complement formal or semi-formal attire. Collar stays, also called collar tabs or collar stiffeners, are flat, rigid pieces of metal or plastic that are inserted into special pockets on the underside of a collared dress shirt. They may either be sewn in or removable. These collar stays are often difficult to insert and can be damaged or lost when the shirt is washed. Collar stays can also cause impressions on the collar when the shirt is ironed.

Cufflinks are used to secure shirt cuffs and are designed to be used with cuffs that have buttonholes but no buttons. They are an acceptable decorative fashion accessory. However, due to placement on the cuffs of a shirt, they are rarely seen or appreciated.

Accordingly, the object of this invention is to provide a shirt with a novel collar system wherein decorative fasteners, such as cufflinks, can be used to keep the collar in place.

SUMMARY OF THE INVENTION

The present invention provides for a dress shirt wherein the collar has been adapted to provide a method of keeping the collar in place with decorative fasteners, such as cufflinks. A dress shirt typically comprises a collar leaf, which is the part of the collar that folds over, a collar band that is attached to the shirt at the front panels and the yolk by a seam. The shirt of the present invention further comprises a set of buttonholes and brackets to receive the fastening device used to keep the collar in place.

In a preferred embodiment, the shirt comprises two sets of two buttonholes, one set on each side of the collar. In this embodiment, within each set of buttonholes, one buttonhole, the "upper", is located on the collar leaf and the other, the "lower", is located on the shirt front right below the seam below the shirt front. The buttonholes may be horizontal or vertical to the seam.

The shirt further comprises two sets of brackets corresponding to each set of buttonholes. Each set of brackets comprises two brackets wherein the lower buttonhole is located in between the two brackets. The brackets may be fabric, elastic, metallic, or plastic and are affixed directly to the shirt. The brackets may be affixed by sewing, gluing, or any other method to affix the bracket to the shirt. In a preferred embodiment, both sets of brackets are secured to the outside of the shirt. However, in alternative embodiments, both sets of brackets may be secured to the inside of the shirt or there may be four sets of brackets wherein two sets are secured to the inside of the shirt and two sets are secured to the outside the shirt.

In a further embodiment, the lower buttonhole is located on the front panel and is parallel to the seam and one bracket is located below the buttonhole and the other bracket is located above the buttonhole on the collar band. It is understood that the buttonholes and brackets may be located vertically or horizontally depending upon the size and shape of the shirt collar.

In a preferred embodiment, the fastening device used to keep the collar in place is a decorative cufflink. The decorative cufflink may be a "double-panel" cufflink, wherein a short post or chain connects two decorative disc-shaped parts, a "swivel-bar" cufflink, wherein a decorative face is connected by a chain or post to a swivel bar, or any other type of cufflink. The cufflink is placed through the upper buttonhole such that the decorative face of the cufflink is located on the outside of the collar leaf. In one embodiment, wherein a swivel-bar cufflink is used the swivel bar may be secured to the shirt by the brackets or through the lower buttonhole. In another embodiment, wherein a double-panel cufflink is used, the second panel may be secured to the shirt by the brackets or through the lower buttonhole. It is understood that any similar fastening device may be used.

Other aspects, features, and advantages will become apparent to those skilled in the art from the detailed description and accompanying drawings. It should be understood, however, that the detailed description and accompanying drawings, while indicating preferred embodiments of the present invention, are given by way of illustration and not limitation.

DETAILED DESCRIPTION OF THE INVENTION

Figure 1:
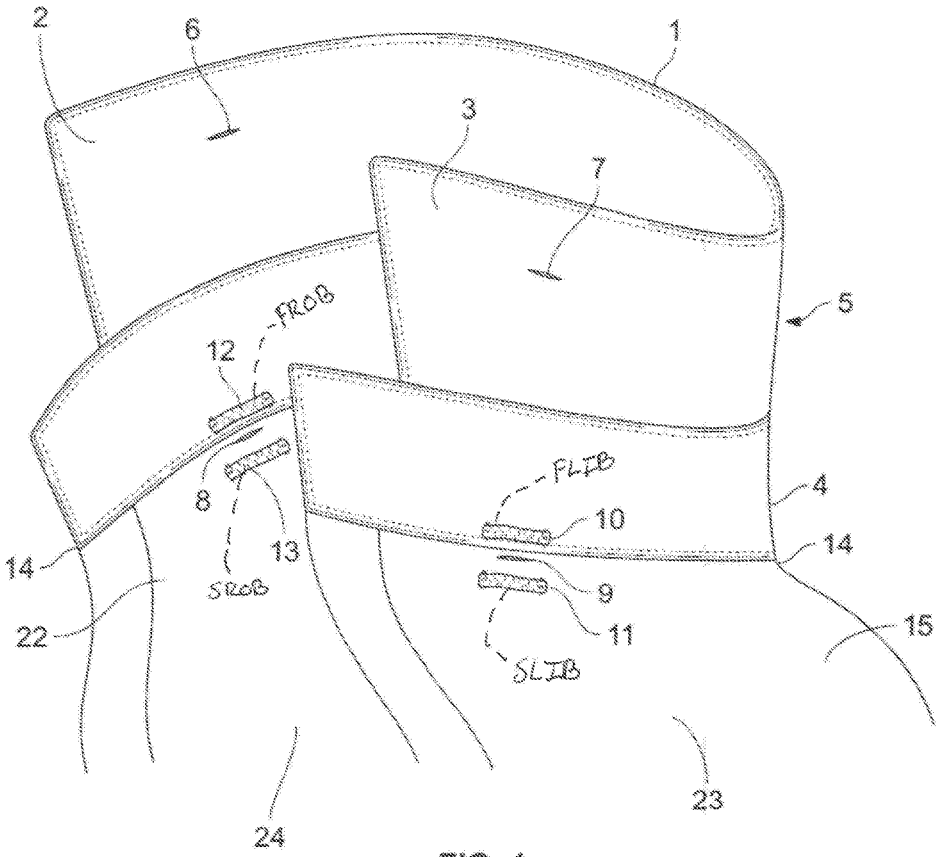
FIG. 1 is a schematic of the present invention showing the embodiment wherein the brackets are attached to the inside of the shirt and the alternative embodiment wherein the brackets are attached to the outside of the shirt. In this schematic representation, the fastening devices to keep the collar in place have not been attached to the collar.

FIG. 1 is a schematic representation of an embodiment of the present invention wherein shirt 5 comprises right front panel 22, left front panel 15, collar band 4, collar leaf 1 and a seam 14 affixing collar band 4 to right front panel 22 and left front panel 5. The collar leaf 1 comprises right collar leaf buttonhole 6 on the right side 2 of collar leaf 1 and left collar leaf buttonhole 7 on the left side 3 of collar leaf 1. Left front panel buttonhole 9 is located on left front panel 15 just below seam 14. Right front panel buttonhole 8 is located on right front panel 22 just below seam 14. First left side bracket 10 (hereinafter FLOB in an embodiment wherein the bracket is on the outside of the shirt) is located above seam

14 on collar band 4 and above left front panel buttonhole 9 and second left side bracket 11 (hereinafter SLOB in an embodiment wherein the bracket is located on the outside of the shirt) is located on left shirt panel 15 below left front panel buttonhole 9 representing an embodiment wherein the first and second left side brackets (10 and 11, FLOB and SLOB) are affixed to the outside 23 of shirt 5. Left front panel buttonhole 9 is in between first left side bracket 10 and second left side bracket 11. In an alternative embodiment, a first left bracket 10 (hereinafter FLIB in an embodiment wherein the bracket is on the inside of the shirt) and a second left side bracket 11 (hereinafter SLIB in an embodiment wherein the bracket is on the inside of the shirt) may be affixed to the inside 24 of shirt 5 wherein left front panel buttonhole 9 is located in between first left bracket 10 (FLIB) and second left side bracket 11 (SLIB). Right front panel buttonhole 8 is located on right shirt front 22 just below seam 14. First right side bracket 12 (hereinafter FRIB in an embodiment wherein the bracket is on the inside of the shirt) is located above seam 14 on collar band 4 and above right front panel buttonhole 8 and second right side bracket 13 (hereinafter SRIB in an embodiment wherein the bracket is on the inside of the shirt) is located on right front panel 22 below right front panel buttonhole 8 representing an embodiment wherein the first and second right side brackets (12 and 13, FRIB and SLIB) are on the inside 24 of shirt 5. Right front panel buttonhole 8 is in between first right side bracket 12 (FRIB) and second right side bracket 13 (SLIB). In an alternative embodiment, a first right side bracket 12 (hereinafter FROB in an embodiment wherein the bracket is on the outside of the shirt) and a second right side bracket 13 (hereinafter SROB in an embodiment wherein the bracket is on the outside of the shirt) may be affixed to the outside 23 of shirt 5, wherein right front panel buttonhole 8 is in between first right side bracket 12 (FROB) and second right side bracket 13 (SROB).

Figure 2:
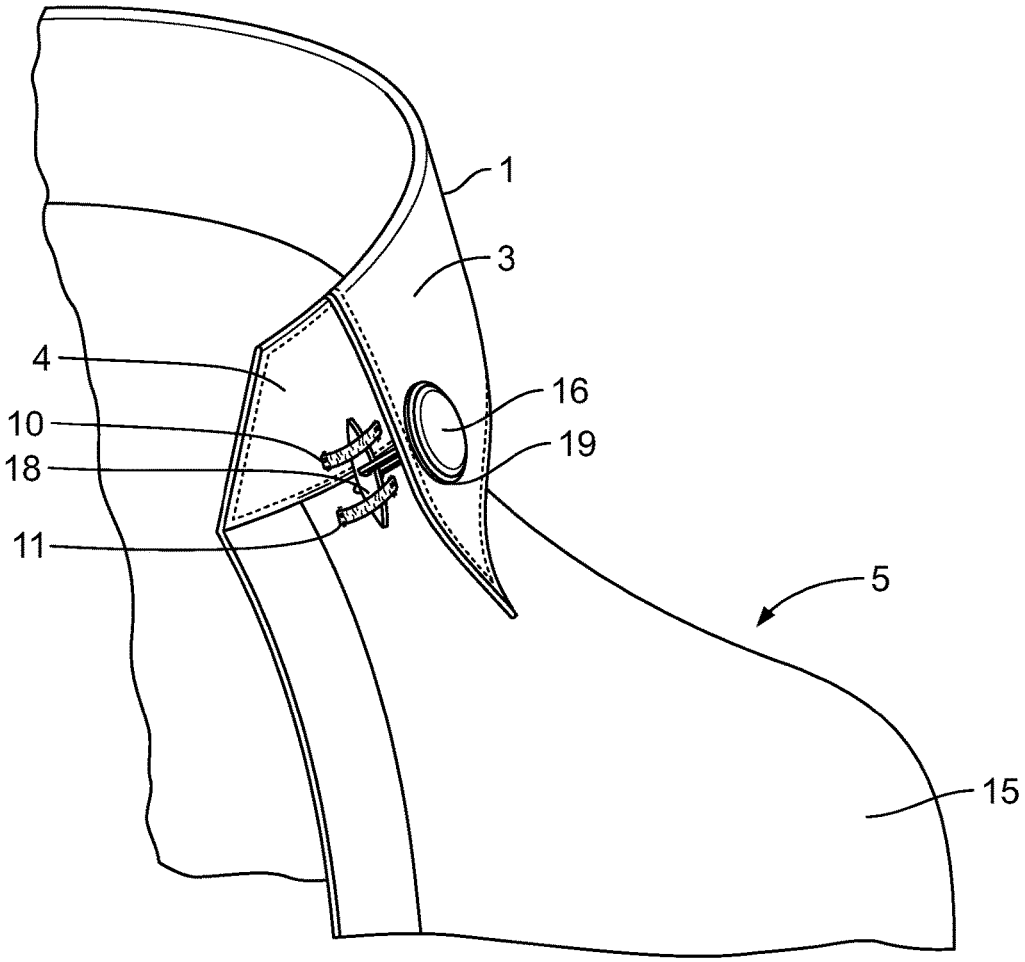
FIG. 2 is a schematic of the present invention wherein a swivel bar cufflink has been used to keep the collar in place.

FIG. 2 is a schematic representation of an embodiment of the present invention wherein swivel bar cufflink 16 has been placed through left collar leaf buttonhole 7 (not visible) such that the decorative top 19 of swivel bar cufflink 16 lays on the left side 3 of collar leaf 1. The swivel bar 18 of swivel bar cufflink 16 is secured to collar band 4 by first left side bracket 10 (FLOB) and to left front panel 15 by second left bracket 11 (SLOB). Not shown in FIG. 2 is right side collar leaf 2 would be held in place in a similar fashion using first right side bracket 12 (FROB) and second right side bracket 13 (SROB).

Figure 3:
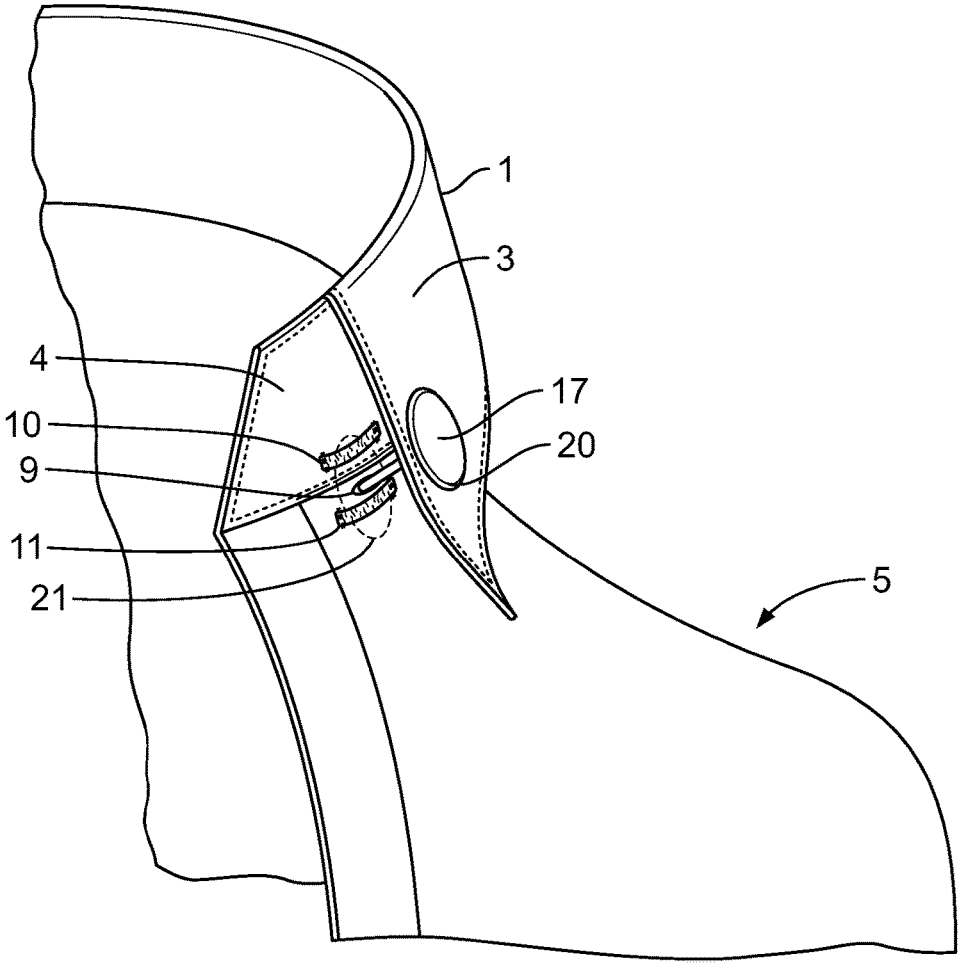
FIG. 3 is a schematic representation of the present invention wherein a double panel cufflink has been used to keep the collar in place.

FIG. 3 is a schematic representation of an embodiment of the present invention wherein double panel cufflink 17 has been placed through left collar leaf buttonhole 7 (not visible) such that the decorative top 20 of double panel cufflink 17 lays on the left side 3 of collar leaf 1. The bottom 21 of double panel cufflink 17 is placed through left front panel buttonhole 9. Not shown in FIG. 3 is right side collar leaf 2 would be held in place in a similar fashion using right front panel buttonhole 8.

I claim:

1. A dress shirt comprising: a collar leaf comprising:

a right side further comprising a buttonhole, and a left side further comprising a buttonhole, a collar band comprising a right side and a left side, a right front panel, a left front panel, a seam wherein the seam affixes the collar band to the left front panel and right front panel, a right front panel buttonhole comprising a first side and a second side positioned on the right front panel adjacent to the seam wherein a first fight side inside bracket and a second right side inside bracket are affixed to the inside of the dress shirt and the first right side inside bracket is adjacent to the first side of the right front panel buttonhole and the second right side inside bracket is adjacent to the second side of the right front panel buttonhole, and a left front panel buttonhole comprising a first side and a second side positioned on the left front panel adjacent to the seam wherein a first left side outside and a second left outside bracket are affixed to the outside of the dress shirt and the first left side bracket is adjacent to the first side of the left front panel buttonhole and the second left side outside bracket is adjacent to the second side of the left front panel buttonhole.

2. A dress shirt comprising: a collar leaf comprising: a right side further comprising a buttonhole, and a left side further comprising a buttonhole, a collar band comprising a right side and a left side, a right front panel comprising an inside and an outside, a left front panel comprising an inside and an outside, a seam wherein the seam affixes the collar band to the left front panel and right front panel, a right front buttonhole comprising a first side and a second side positioned on the right front panel adjacent to the seam wherein a first right side outside bracket and a second right side outside bracket are affixed to the outside of the right front panel and the first right side outside bracket is adjacent to the first side of the right front buttonhole and the second right side outside bracket is adjacent to the second side of the right front panel buttonhole, and a left from panel buttonhole comprising a first side and a second side positioned on the left front panel adjacent to the seam wherein a first left side outside bracket and a second left side outside bracket are affixed to the outside of the left front panel and the first left side outside bracket is adjacent to the first side of the left front buttonhole and the second left outside bracket is adjacent to the second side of the left front panel buttonhole.

3. The dress shirt of claim 2 further comprising:

a first right side inside bracket and a second right side inside bracket affixed to the inside of the right front panel wherein the first right side inside bracket is adjacent to the first side of the right front buttonhole and the second right side inside bracket is adjacent to the second side of the right front panel buttonhole, and a first left side inside bracket and a second left side inside bracket affixed to the inside of the left front panel wherein the first left side inside bracket is adjacent to the first side of the left front buttonhole and the second left side inside bracket is adjacent to the second side of the left front panel buttonhole.

4. A dress shirt comprising:

a collar leaf comprising:

a right side further comprising a buttonhole, and a left side further comprising a buttonhole, a collar band comprising a right side and a left side, a right front panel comprising an inside and an outside, a left front panel comprising an inside and an outside, a seam wherein the seam affixes the collar hand to the left front panel and right front panel, a right front buttonhole comprising a first side and a second side positioned on the front panel adjacent to the seam wherein a first right side inside bracket and a second right side inside bracket are affixed to the inside of the right front panel and the first right side inside bracket is adjacent to the first side of the right front buttonhole and the second right side inside bracket is adjacent to the second side of the right front panel buttonhole, and a left front panel buttonhole comprising a first side and a second side positioned on the left front panel adjacent to the seam wherein a first left side inside bracket and a second left side inside bracket are affixed to the inside of the left front panel and the first left side inside bracket is adjacent to the first side of the left front buttonhole and the second left side inside bracket is adjacent to the second side of the left front panel buttonhole.

* * * * *